US011270615B2

(12) United States Patent
Choi et al.

(10) Patent No.: US 11,270,615 B2
(45) Date of Patent: Mar. 8, 2022

(54) DISPLAY DEVICE

(71) Applicant: SILICON WORKS CO., LTD., Daejeon (KR)

(72) Inventors: Jung Min Choi, Daejeon (KR); Ju Ho Lee, Daejeon (KR); Jung Hwan Choi, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 16/984,633

(22) Filed: Aug. 4, 2020

(65) Prior Publication Data

US 2021/0043125 A1 Feb. 11, 2021

(30) Foreign Application Priority Data

Aug. 8, 2019 (KR) ..... 10-2019-0096770

(51) Int. Cl.
*G09G 3/20* (2006.01)

(52) U.S. Cl.
CPC ..... *G09G 3/20* (2013.01); *G09G 2310/0286* (2013.01); *G09G 2310/0291* (2013.01); *G09G 2310/08* (2013.01); *G09G 2370/08* (2013.01)

(58) Field of Classification Search
CPC ..... G09G 3/20; G09G 2310/08; G09G 2310/0291; G09G 2310/0286; G09G 2370/08; G09G 2320/103; G09G 2310/0275; G09G 2330/06; G09G 2330/021; G09G 3/2092; G09G 2310/0264; G09G 2370/16
See application file for complete search history.

(56) References Cited

U.S. PATENT DOCUMENTS

2009/0021462 A1* 1/2009 Furihata ..... G09G 3/2018 345/89
2011/0025656 A1* 2/2011 Huang ..... G09G 3/3688 345/204
2012/0086677 A1* 4/2012 Lin ..... G09G 3/20 345/204
2016/0140892 A1 5/2016 Park et al.
2016/0189336 A1* 6/2016 Lee ..... G09G 5/393 345/589
2016/0189684 A1* 6/2016 Ko ..... G09G 3/36 345/205
2017/0193892 A1* 7/2017 Ha ..... G09G 3/2022
2019/0155432 A1* 5/2019 Park ..... G09G 3/2096
2019/0385504 A1* 12/2019 Jeong ..... G09G 5/008

FOREIGN PATENT DOCUMENTS

JP 2008-216952 A 9/2008
JP 5508662 B2 6/2014
KR 10-0847998 B1 7/2008
KR 10-2016-0057571 A 5/2016
KR 10-2016-0069921 A 6/2016
KR 2019-0017603 A 2/2019

* cited by examiner

*Primary Examiner* — Grant Sitta
(74) *Attorney, Agent, or Firm* — Fenwick & West LLP

(57) ABSTRACT

An embodiment of the present disclosure relates to a display device allowing minimizing repetitive transmissions and receptions of identical pieces of image data so as to reduce power consumption due to the repetitive transmissions and receptions of identical pieces of image data.

14 Claims, 13 Drawing Sheets

DISPLAY DEVICE

CROSS REFERENCE TO RELATED APPLICATION

This application claims priority from Republic of Korea Patent Application No. 10-2019-0096770, filed on Aug. 8, 2019, which is hereby incorporated by reference in its entirety.

BACKGROUND

1. Field of Technology

The present disclosure relates to a display device minimizing repetitive transmissions and receptions of identical pieces of image data.

2. Description of the Prior Art

A display device may comprise a panel, a source driver for driving the panel, and a timing controller for controlling the drive of the source driver. A panel comprises a plurality of pixels forming rows and columns that are disposed side by side in a horizontal direction and in a vertical direction so that the plurality of pixels are placed on the panel in a form of a matrix. A row formed by the plurality of pixels when they are disposed in the horizontal direction may also be referred to as a line.

A source driver may simultaneously drive the plurality of pixels in one line. The plurality of pixels in one line may respectively receive image signals from the source driver through data lines disposed in the vertical direction. The plurality of pixels may display images according to these image signals.

A timing controller may transmit drive control data and image data to the source driver. The timing controller may control timing for the source driver to drive the panel using the drive control data. The source driver may receive image data and generate image signals for driving the panel from the image data.

The process of transmitting image data (image signals) from the timing controller to the panel is equally carried out even when image data of a certain line is identical to image data of a subsequent line. That is, even though pieces of image data of two lines are identical, the identical pieces of image data are repeatedly transmitted. The repetitive transmissions of the multiple pieces of identical image data may cause unnecessary transactions and this may lead to an increase of power consumption and electro-magnetic interference (EMI) of a display device.

SUMMARY

In this background, an aspect of the present disclosure is to provide a technology for re-supplying image data of a previous line to a subsequent line when two pieces of image data of sequentially driven two lines are identical.

Another aspect of the present disclosure is to provide a technology for re-supplying image data of a previous group when multiple pieces of image data of two groups, each comprising a plurality of lines, are identical.

Still another aspect of the present disclosure is to provide a technology in which a re-supply of image data of a previous line or a previous group is carried out by a relevant source driver among a plurality of them.

Still another aspect of the present disclosure is to provide a technology in which a re-supply of image data of a previous line or a previous group is carried out by controlling latches and switches.

To this end, according to an aspect, there is provided a source driver comprising: a drive control circuit to receive a data packet, including a control block and a data block, and to generate a control signal according to the control block; and a latch circuit, comprising a first latch and a second latch, to output image data stored in the first latch or the second latch according to the control signal, wherein, in a case when first image data outputted to a first line is identical to second image data outputted to a second line, data included in the control block commands the second line to reuse the first image data and the data block does not include the second image data.

In the source driver, the data block may embed a clock therein.

In the data block, a part, into which image data is inserted, may have logical levels of 0 only or 1 only or any data.

The source driver may comprise a serial-parallel converting circuit to convert image data received in series into image data in parallel and to output it to the latch circuit; and a clock control circuit to deactivate the serial-parallel converting circuit by masking a clock inputted into the serial-parallel converting circuit according to the control signal.

In the source driver, the latch circuit may comprise a switch connecting the first latch and the second latch and open the switch according to the control signal. The second latch may store the first image data in a first time section where the first line is driven and output the first image data to the second line in a second time section where the second line is driven.

According to another aspect, there is provided a source driver comprising: a drive control circuit to receive a plurality of data packets, each including a control block and a data block and to generate control signals according to the control blocks; and a latch circuit, comprising a first latch and a second latch, to output image data stored in the first latch or the second latch according to the control signals, wherein, in a case when image data for a first group comprising a first line and a second line is identical to image data for a second group comprising a third line and a fourth line, data included in the control block commands the second group to reuse the image data for the first group and the data block does not include the image data for the second group.

In the source driver, the plurality of data packets may include a first data packet comprising a first control block including data to command the third line to reuse image data for the first line and a first data block, and a second data packet comprising a second control block including data to command the fourth line to reuse image data for the second line and a second data block, the drive control circuit may generate a first control signal according to the first control block and a second control signal according to the second control block, and the latch circuit may output the image data for the first line to the third line according to the first control signal and the image data for the second line to the fourth line according to the second control signal.

In the source driver, the latch circuit may comprise a first switch connected with the first latch and a second switch connected with the second latch and output the image data for the first group to the second group by alternately closing the first switch and the second switch.

In the source driver, the first switch may close, the second switch may be connected between the first latch and the second latch so that an output from the second latch may be inputted into the first latch, and the latch circuit may supply image data for the first group to the second group according to the opening or the closing of the second switch.

In the source driver, the first and the second data blocks may respectively embed clocks therein.

In the first and the second data blocks, parts, into which image data is inserted, may have logical levels of 0 only or 1 only or any data.

According to another aspect, there is provided a display device comprising: a panel comprising a plurality of pixels disposed to form lines, the panel being divided into a plurality of areas, each including a first line and a second line; a plurality of source drivers to respectively drive the plurality of areas of the panel; and a timing controller to generate a data packet comprising a control block and a data block for each area and to transmit the data packet to a corresponding source driver, wherein, in a case when first image data outputted to the first line is identical to second image data outputted to the second line in each area, data included in the control block commands the second line to reuse the first image data and the data block does not include the second image data.

In the display device, each source driver may comprise a latch circuit, comprising a first latch and a second latch, to output the first image data to the second line according to a control signal generated on the basis of the control block by the first and the second latches.

In the display device, the timing controller may embed a clock in the data block.

In the data block, a part, into which image data is inserted, may have logical levels of 0 only or 1 only or any data.

In the display device, in a case when image data of a first group including a first line and a second line is identical to image data of a second group including a third line and a fourth line in each area, the timing controller may generate a plurality of data packets for the respective areas, each comprising a control block including data to command the second group to reuse image data for the first group and a data block not including image data, and transmit the plurality of data packets respectively to the corresponding source drivers.

As described above, the present disclosure allows reducing power consumption of a display device by minimizing unnecessary interface transactions due to multiple pieces of identical image data.

In addition, the present disclosure allows reducing EMI due to the unnecessary interface transactions.

DETAILED DESCRIPTION

Figure 1:
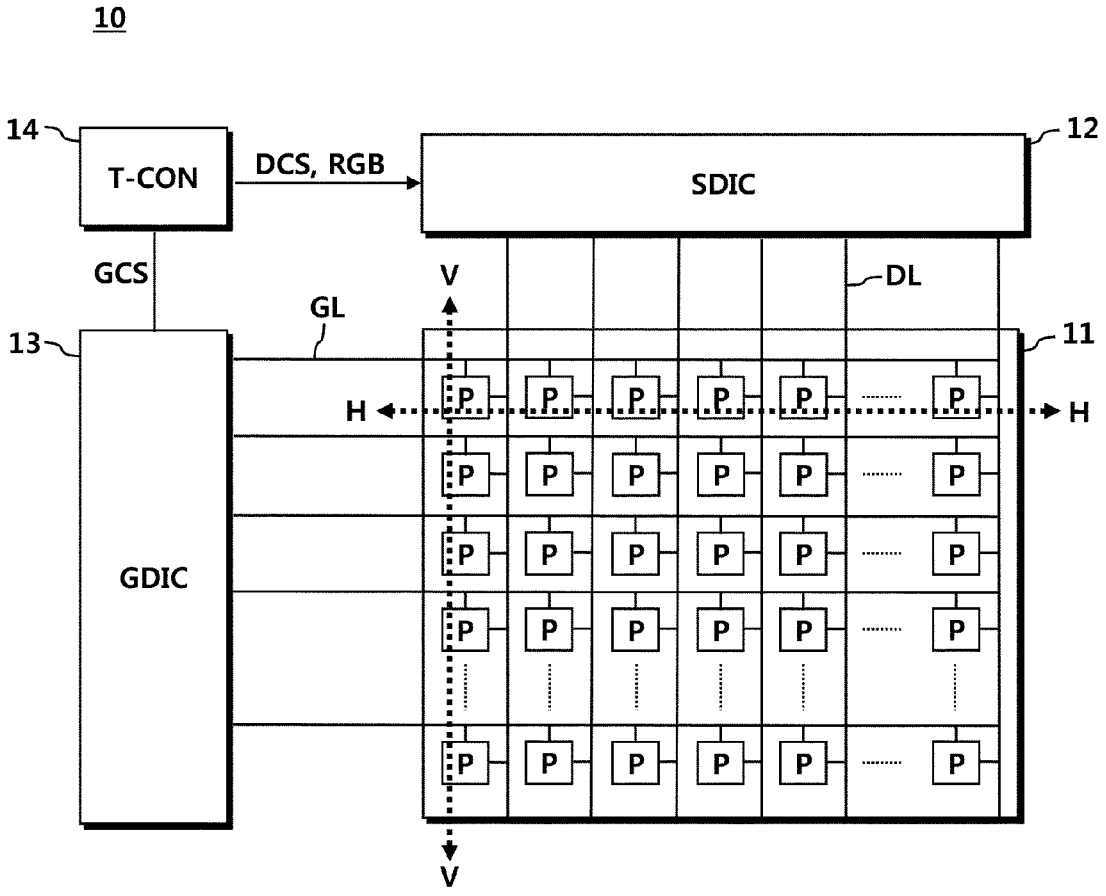
FIG. 1 is a configuration diagram of a display system according to an embodiment.

FIG. 1 is a configuration diagram of a display system according to an embodiment.

Referring to FIG. 1, a display device 10 may comprise a panel 11, a source driver 12, a gate driver 13, and a timing controller 14.

On the panel 11, a plurality of data lines DL and a plurality of gate lines GL may be disposed and a plurality of pixels P may also be disposed. The plurality of pixels P may be disposed side by side, in a horizontal direction H, and in a vertical direction V so as to form a square shape as a whole. Since this square shape is similar to a matrix shape, a set of a plurality of pixels P arranged in the horizontal direction H or a horizontal line that the plurality of pixels P form may be referred to as a row or a line, and a set of a plurality of pixels P arranged in the vertical direction V or a vertical line that the plurality of pixels P form may be referred to as a column.

The gate driver 13 may supply scan signals, such as turn-on voltages or turn-off voltages, through the gate lines GL. When a scan signal of a turn-on voltage is supplied to a pixel P, the pixel P is connected with a data line DL, whereas, when a scan signal of a turn-off voltage is supplied to a pixel P, the pixel P is disconnected from the data line DL.

The source driver 12 may supply data voltages through the data lines DL. A data voltage supplied through a data line DL may be supplied to a pixel P connected with the data line DL according to a scan signal.

The timing controller 14 may supply various control signals to the gate driver 13 and the source driver 12. The timing controller 14 may generate a gate control signal GCS to initiate a scan according to a timing for each frame and transmit the gate control signal GCS to the gate driver 13. The timing controller 14 may convert image data inputted from outside into image data RGB in a data format used in the source driver 12 and transmit the converted image data RGB to the source driver 12. In addition, the timing controller 14 may transmit a data control signal DCS to control the source driver 12 to supply a data voltage to each pixel P at an appropriate timing.

Figure 2:
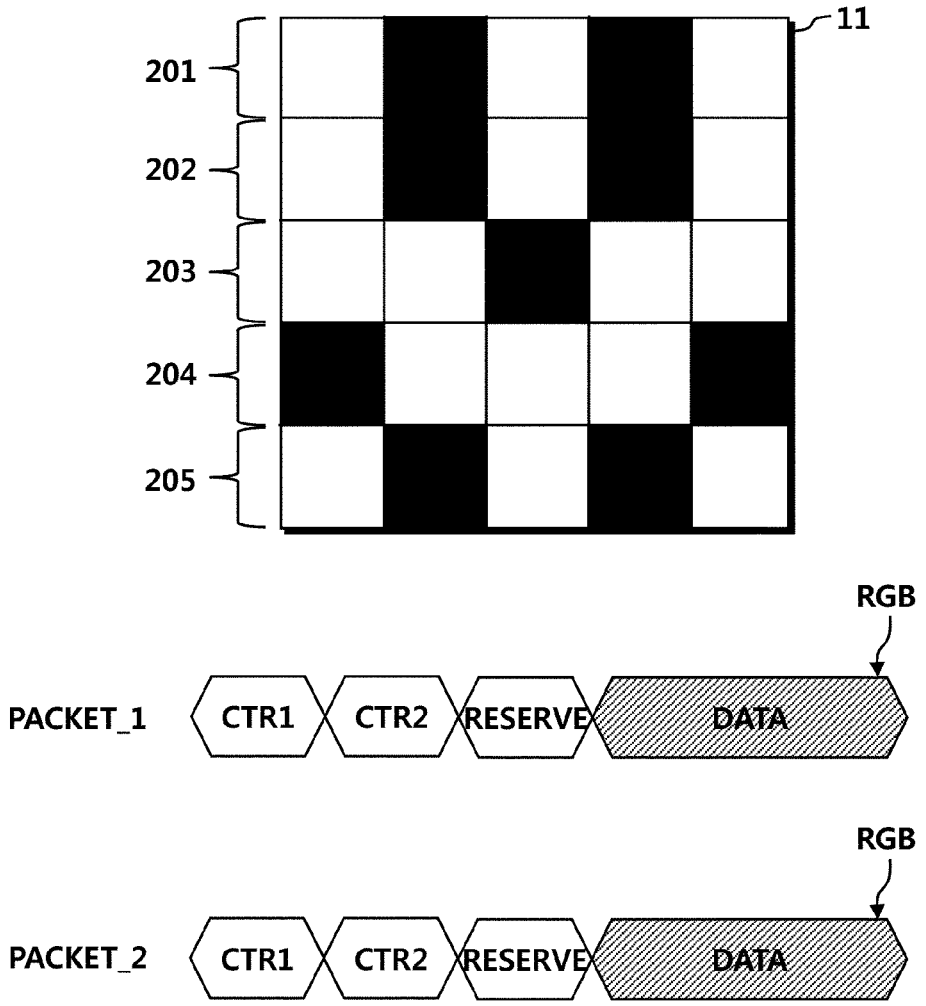
FIG. 2 is a diagram illustrating a conventional data packet.

FIG. 2 is a diagram illustrating a conventional data packet.

FIG. 2 shows logical levels of image data RGB displayed by pixels of the panel 11 and data packets including image data RGB.

The timing controller may transmit image data RGB to the source driver and the source driver may generate a data voltage corresponding to the image data RGB and transmit the data voltage to the panel 11. In the panel 11, greyscale values of 0 to 255 may be outputted to the pixels P using the data voltages. For example, greyscale values (255, 0, 255, 0, 255) may be outputted to a first line 201, greyscale values (255, 0, 255, 0, 255) may be outputted to a second line 202, greyscale values (255, 255, 0, 255, 255) may be outputted to a third line 203, greyscale values (0, 255, 255, 255, 0) may be outputted to a fourth line 204, and greyscale values (255, 0, 255, 0, 255) may be outputted to a fifth line 205. In the figures of the present disclosure, a black pixel may have a greyscale value of 0 and a white pixel may have a greyscale value of 255.

The timing controller may put image data RGB in a data packet comprising a series of pieces of data and transmit it. The data packet may comprise a control block including a command for controlling the drive of the source driver and a data block including image data RGB. For example, a first data packet PACKET_1 for driving the first line 201 of the panel 11 may comprise a plurality of control blocks CTR1, CTR2 and a data block DATA.

Here, even when image data RGB for a current line is identical to image data RGB for a previous line, the source driver may newly receive image data RGB for the current line, which is identical to image data RGB for the previous line, from the timing controller and drive the panel using the newly received image data RGB. For example, greyscale values outputted to the first line 201 and the second line 202 of the panel 11 may identically be (255, 0, 255, 0, 255). In this case, the timing controller may transmit a second data packet PACKET_2 including image data RGB, identical to image data RGB of a first data packet PACKET_1, outputted to the first line 201, to the source driver for the drive of the second line 202. The source driver drives the second line 202 using the image data RGB identical to the image data RGB for the first line 201. That is, the source driver may output the image data RGB identical to the image data RGB for the first line 201 to the second line 202.

Such an additional data transmission-reception transaction, in other words, an operation, in which the timing controller re-generates image data RGB identical to that for a previous line and the source driver drives the panel 11 using the same image data RGB, may be unnecessary. Such an unnecessary operation may increase current consumption (power consumption) of a display device and cause electromagnetic interference (EMI) due to such a transmission-reception.

Figure 3:
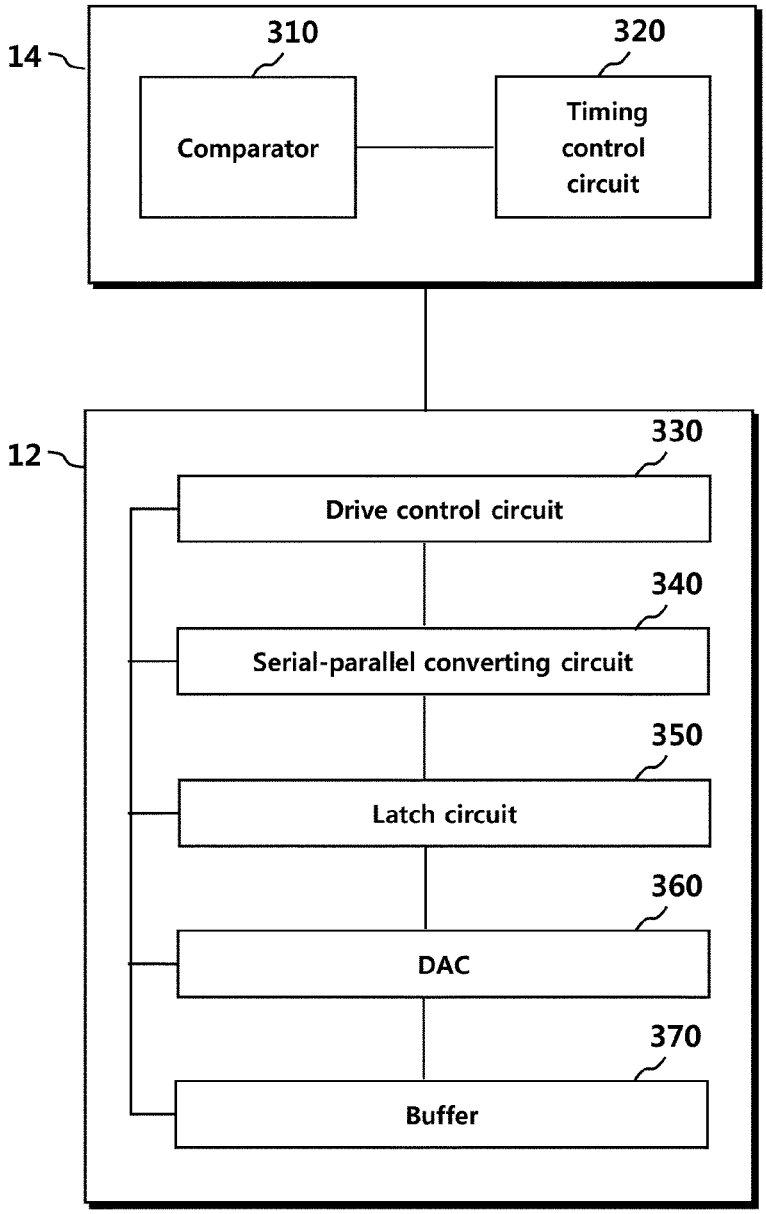
FIG. 3 is a configuration diagram of a timing controller and a source driver according to an embodiment.

FIG. 3 is a configuration diagram of a timing controller and a source driver according to an embodiment.

Referring to FIG. 3, the timing controller 14 may comprise a comparator 310 and a timing control circuit 320 and the source driver 12 may comprise a drive control circuit 330, a serial-parallel converting circuit 340, a latch circuit 350, a digital-analog converting circuit (DAC) 360, and a buffer 370.

The comparator 310 may determine whether image data for a previous line of the panel is identical to image data for a current line thereof. For example, in a case when image data RGB for the first line 201 is identical to image data RGB for the second line 202 as shown in FIG. 2, the comparator 310 may determine that image data for a previous line is identical to image data for a current line. The comparator 310 may transmit a result of determination to the timing control circuit 320.

The comparator 310 may respectively compare bits of two pieces of image data. For example, the comparator 310 may determine if two pieces of image data are identical to each other by applying an exclusive OR operation to bits.

The timing control circuit 320 may generate a data packet based on a result of determination of the comparator 310. A data packet may comprise a control block and a data block. The timing control circuit 320 may include, in the control block, data for controlling the source driver 12 to supply again image data, already supplied to a previous line, to a current line, and no data in the data block. A data packet generated by the timing controller 14, in a case when multiple pieces of image data of multiple lines are identical, will be specifically described later.

The drive control circuit 330 may receive a data packet from the timing control circuit 320.

The drive control circuit 330 may generate a control signal using the received data packet and control the latch circuit 350 by the control signal. The drive control circuit 330 may generate the control signal on the basis of data included in the data packet. The control signal may include information of controlling the latch circuit 350 to supply again image data, already supplied to a previous line, to a current line. The control signal may further include a clock transferred to the latch circuit 350.

For example, the drive control circuit 330 may stop or maintain the drive of the latch circuit 350 by adjusting a clock of a control signal transferred to the latch circuit 350. The latch circuit 350, which has received the control signal, may be set to supply again image data, already supplied to a previous line, to a current line, store the image data for a previous line, and re-supply the image data to a current line.

In a case when the latch circuit 350 includes a switch connecting a plurality of latches, the drive control circuit 330 may stop or maintain the drive of the latch circuit 350 by controlling the opening and the closing of the switch by a control signal. The switch of the latch circuit 350, which has received the control signal, may be set to supply again image data, already supplied to a previous line, to a current line, and the plurality of latches of the latch circuit 350 may store the image data for a previous line, and re-supply the image data to a current line.

The drive control circuit 330 may include, in a control signal, a clock transferred to the DAC 360 and the buffer 370. The drive control circuit 330 may control the operation of the DAC 360 and the buffer 370 by adjusting the clock.

The serial-parallel converting circuit 340 may receive image data transmitted from the timing controller 14 by the drive control circuit 330 and convert the image data in a serial form into a parallel form.

The latch circuit 350 may latch image data. The latch circuit 350 may temporarily store image data, and then, output it to the DAC 360. Specifically, the latch circuit 350 may comprise a first latch and a second latch. The first latch may temporarily store image data, and then, output it to the second latch according to a clock of a control signal. The second latch may receive the image data from the first latch, temporarily store it, and then, output it to the DAC 360 according to the clock of the control signal.

The DAC 360 may receive image data from the latch circuit 350. The DAC 360 may generate an analog image signal by converting the image data. The DAC 360 may select a greyscale voltage corresponding to image data received from the second latch, among greyscale voltages of 0 to 255 generated from a gamma reference voltage inputted from outside, and output the greyscale voltage to the buffer 370. The analog image signal may be the selected greyscale voltage or a data voltage supplied to a data line.

The buffer 370 may receive an analog image signal from the DAC 360. The buffer 370 may amplify the analog image signal and supply it to a data line.

Figure 4:
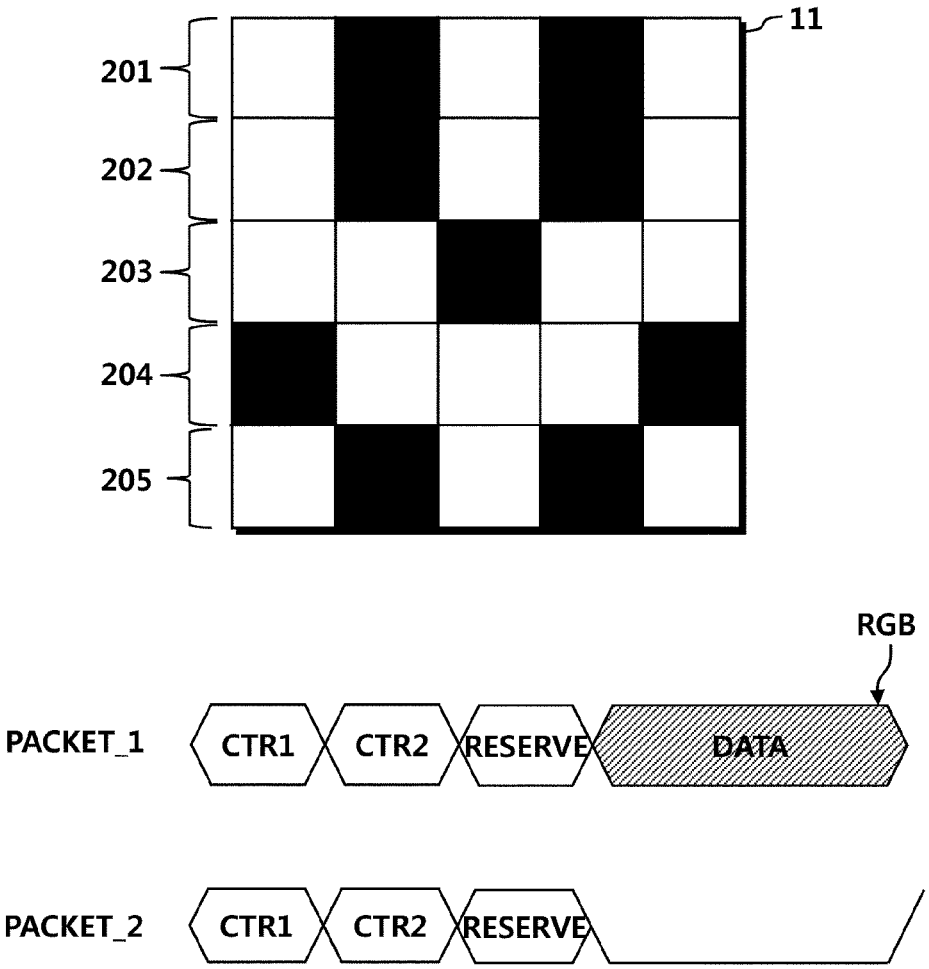
FIG. 4 is a diagram illustrating a data packet according to an embodiment.

FIG. 4 is a diagram illustrating a data packet according to an embodiment.

In a case when there are adjacent two lines having identical pieces of image data RGB, the timing controller 14 may control the source driver 12 to output again a data voltage, already outputted to a previous line, to a current line.

FIG. 4 shows structures of data packets generated by the timing controller 14 in a case when image data RGB for a previous line is identical to image data RGB for a current line. When the timing controller 14 compares image data RGB for a current line with image data RGB for a previous line and determines that they are identical, the timing controller 14 may generate a data packet including a command to re-use image data RGB for the previous line without newly transmitting image data RGB.

Supposing that, for example, the panel 11 displays an image as shown in FIG. 2 in a first through a fifth lines of pixels P, greyscale values of image data for the first line 201 and for the second line 202 may identically be (255, 0, 255, 0, 255). The timing controller 14 may include image data RGB for the first line 201 in a data block DATA to generate a first data packet PACKET_1 and transmit the first data packet PACKET_1 to the source driver 12.

Subsequently, the timing controller 14 may compare the image data RGB for the second line 202 with the image data RGB for the first line 201 before transmitting the image data RGB for the second line 202 to the source driver 12. Since the greyscale values of the image data RGB for the first line 201 and the second line 202 are identically (255, 0, 255, 0, 255), the comparator 310 of the timing controller 14 may determine that the two pieces of the image data RGB are identical.

The timing control circuit of the timing controller may generate a second data packet PACKET_2 according to the aforementioned determination. The timing control circuit may not include the image data RGB for the second line 202, which is identical to the image data RGB for the first line, in a data block DATA. The data block DATA may have logical levels of 0 only or 1 only. Or, the data block DATA may have any other data in an arbitrary format.

The timing control circuit may include, in control blocks CTR1, CTR2, command data to re-apply the image data RGB for the first line 201 to the panel. That is, the command data may comprise information of re-supplying the image data RGB for the first line 201 to the second line 202 because the image data RGB for the second line 202 is identical to the image data RGB for the first line 201.

When the comparator determines that the image data RGB for the second line 202 is different from the image data RGB for the first line 201, the timing control circuit may include data different from the image data for the first line 201 in the data block DATA. The timing control circuit may not include, in the control blocks CTR1, CTR2, command data to re-apply image data RGB for the first line 201 to the panel. That is, data included in the control blocks CTR1, CTR2 may comprise information of supplying image data RGB included in the second data packet PACKET_2 to the second line 202 because the image data RGB for the second line 202 is different from the image data RGB for the first line 201.

Figure 5:
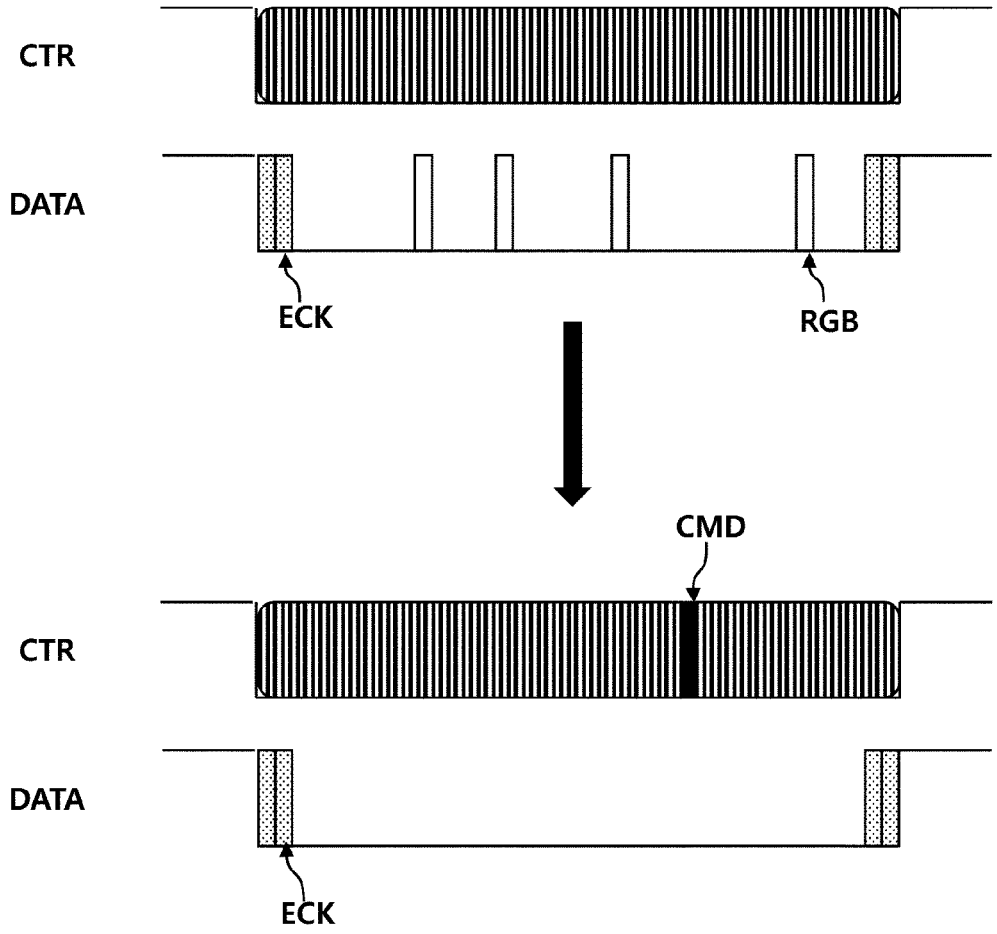
FIG. 5 is a diagram of a first example illustrating a control block and a data block of a data packet according to an embodiment.

FIG. 5 is a diagram of a first example illustrating a control block and a data block of a data packet according to an embodiment.

FIG. 5 illustrates, according to a first example, in an upper portion, a control block and a data block of a data packet in a case when image data for a previous line and image data for a current line are not identical, and in a lower portion, the control block and the data block of the data packet in a case when image data for a previous line and image data for a current line are identical.

A control block CTR of a data packet may include data for controlling the drive of the source driver. The data may include command data CMD to control the source driver to re-supply image data, already supplied to a previous line, to a current line.

A data block DATA of a data packet may include image data RGB and a clock ECK. The image data RGB may be converted into an analog image signal (a data voltage) and outputted to a pixel P of the panel. A clock ECK, which is a digital signal to synchronize the source driver, may be embedded in a data block DATA together with image data RGB, without being included in a separate block, and transmitted to the source driver.

When image data for a previous line is not identical to image data for a current line, the timing controller may generate a data packet in which a clock ECK and image data RGB are included in a data block DATA as shown in the upper portion.

On the contrary, when image data for a previous line is identical to image data for a current line, the timing controller may only include a clock ECK without image data RGB in a data block DATA as shown in the lower portion. Additionally, the timing controller may include, in the control block CTR, a command to supply again image data for a previous line to a current line. The timing controller may generate a data packet from which image data RGB is excluded.

Figure 6:
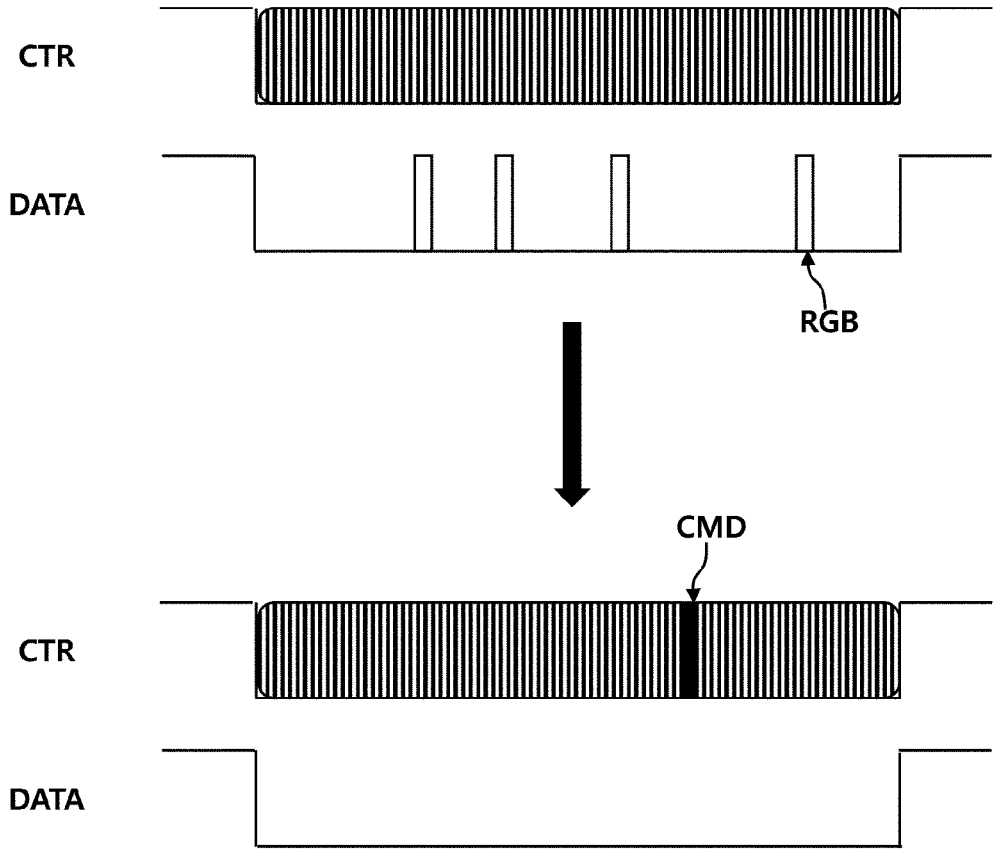
FIG. 6 is a diagram of a second example illustrating a control block and a data block of a data packet according to an embodiment.

FIG. 6 is a diagram of a second example illustrating a control block and a data block of a data packet according to an embodiment.

FIG. 6 illustrates, according to a second example, in an upper portion, a control block and a data block of a data packet in a case when image data for a previous line and image data for a current line are not identical, and, in a lower portion, the control block and the data block of the data packet in a case when image data for a previous line and image data for a current line are identical.

Differently from FIG. 5, a data block DATA of a data packet may not include a clock ECK. The timing controller may include a clock in a separate block exclusive for the clock without embedding the clock in the data block.

Accordingly, when image data for a previous line is not identical to image data for a current line, the timing controller may generate a data packet including image data RGB without a clock in a data block DATA as shown in the upper portion.

On the contrary, when image data for a previous line is identical to image data for a current line, the timing controller may exclude a clock and image data RGB from the data block. Additionally, the timing controller may include a command CMD to re-supply image data for a previous line to a current line in the control block CTR. In this way, the timing controller may generate a data packet from which image data RGB is excluded.

Figure 7:
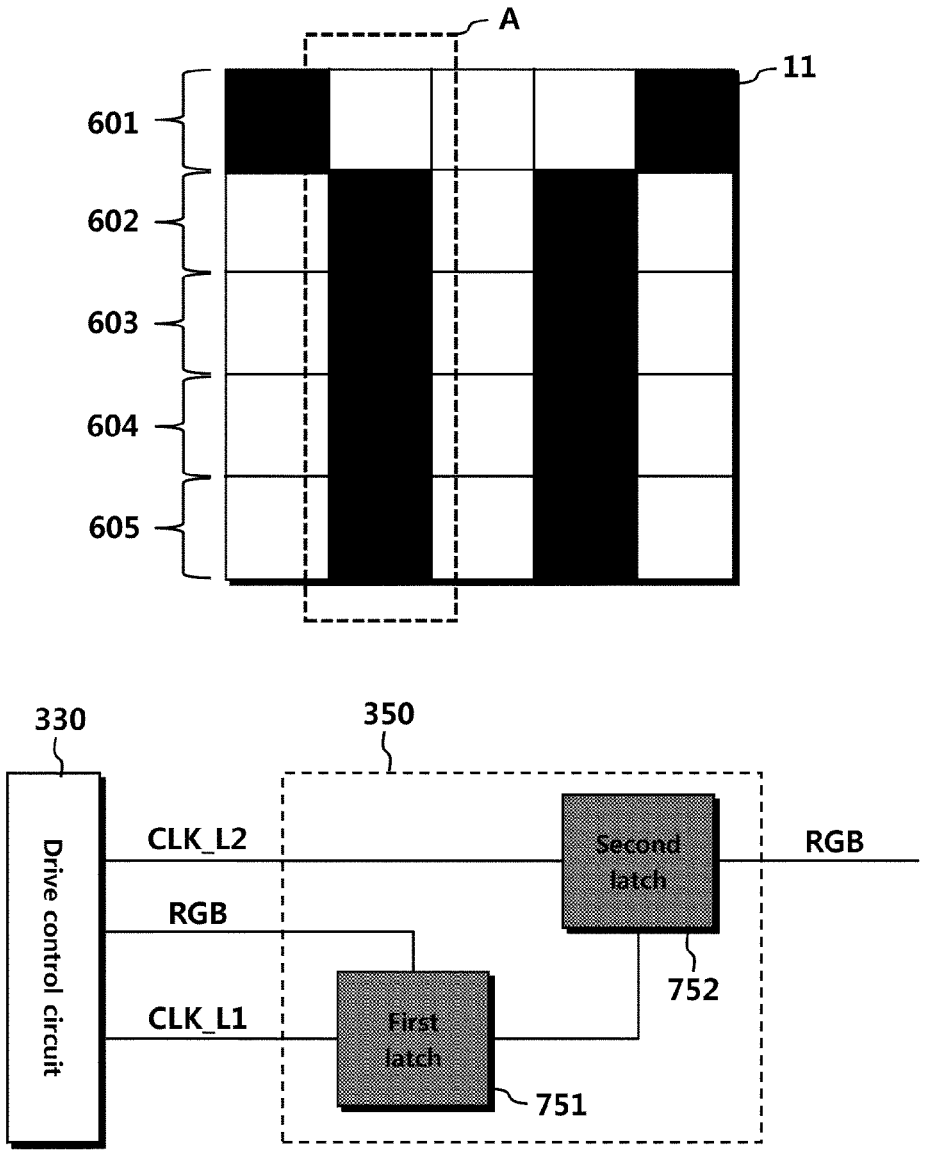
FIG. 7 is a diagram illustrating a first example of controlling a latch to supply image data of a previous line to a current line according to an embodiment.

FIG. 7 is a diagram illustrating a first example of controlling a latch to supply image data of a previous line according to an embodiment.

Referring to FIG. 7, according to a first example, the source driver may output image data RGB for a previous line to a current line by controlling the latch circuit 350. The latch circuit 350 may comprise a first latch 751 and a second latch 752.

The drive control circuit 330 may control states of the first latch 751 and the second latch 752 to repeatedly output image data RGB for a previous line to a current line. The first latch 751 and the second latch 752 may repetitively output a bit value of image data RGB for a pixel located in a previous line of a certain column (channel) to a pixel located in a current line of the same column (channel).

For example, greyscale values of (0, 255, 255, 255, 0) may be outputted to a first line 601 and greyscale values of (255, 0, 255, 0, 255) may be outputted to a second to a fifth lines 602, 603, 604, 605. Since pieces of image data RGB for the second to fifth lines 602, 603, 604, 605 are identical, the source driver may repetitively supply image data RGB for the second line 602 to the third line through the fifth line 603, 604, 605. Taking a column (for example, a second column) as an example as shown in an area A marked in a dotted line, greyscale values of (255, 0, 0, 0, 0) may be outputted respectively to the first line through the fifth line of the second column. The latch circuit 350 assigned to the second column (the second channel) A may repetitively output a greyscale value of 0, corresponding to image data RGB for the second line 602, to the third line through the fifth line 603, 604, 605 in the same column.

The drive control circuit 330 may control the second latch 752 to repetitively output image data RGB for a previous line to a current line by adjusting a clock supplied to the first latch 751 and the second latch 752. For example, the second latch 752 may store image data RGB regarding the greyscale value of 0 outputted in the second line 602 of the second column A. Since a greyscale value for a pixel comprises 8 bits (a first to an eighth bits), the second latch 752 may store values of 8 bits. As an example, the second latch 752 may store image data RGB regarding the greyscale value of 0. The second latch 752 may output the stored image data RGB regarding the greyscale value of 0 according to a control signal generated by the drive control circuit 330.

Specifically, the drive control circuit 330 may receive a data packet from the timing controller and generate a control signal according to data included in a control block of the data packet. The control signal may comprise a first latch clock CLK_L1 for driving the first latch 751 and a second latch clock CLK_L2 for driving the second latch 752. The drive control circuit 330 may transfer the first latch clock CLK_L1 including a storage signal to the first latch 751 and the second latch clock CLK_L2 including a storage signal to the second latch 752. The first latch 751 may store existing image data RGB without newly receiving any image data RGB (the first latch 751 in a storing state is represented by shade). Since the second to the fifth lines 602, 603, 604, 605 have the same image data RGB to be inputted, the first latch 751 may not newly receive any image data RGB from the drive control circuit 330, and thus, no new data may be stored in the first latch 751.

The second latch 752 as well may store only existing image data RGB without newly receiving any image data RGB (the second latch 752 in a storing state is represented by shade). In this figure, the stored existing image data RGB may be image data RGB regarding the greyscale value of 0 of the second line 602 in the second column. The second latch 752 may output the image data RGB, regarding the greyscale value of 0 of the second line 602 in the second column, to the third to the fifth lines 603, 604, 605 of the second column.

According to the first example, the latch circuit 350 may re-supply image data RGB for the second line 602 to the third to the fifth lines 603, 604, 605 in each of a first to a fifth columns (channels). The latch circuits 350 for the first, third, and fifth columns (channels) may respectively output repeatedly image data RGB corresponding to a greyscale value of 255 and the latch circuits 350 for the second and the fourth columns (channels) may respectively output repeatedly image data RGB corresponding to a greyscale value of 0. The source driver may repeatedly output image data RGB for a previous line to a current line without newly receiving the same image data RGB in every column (channel).

Figure 8:
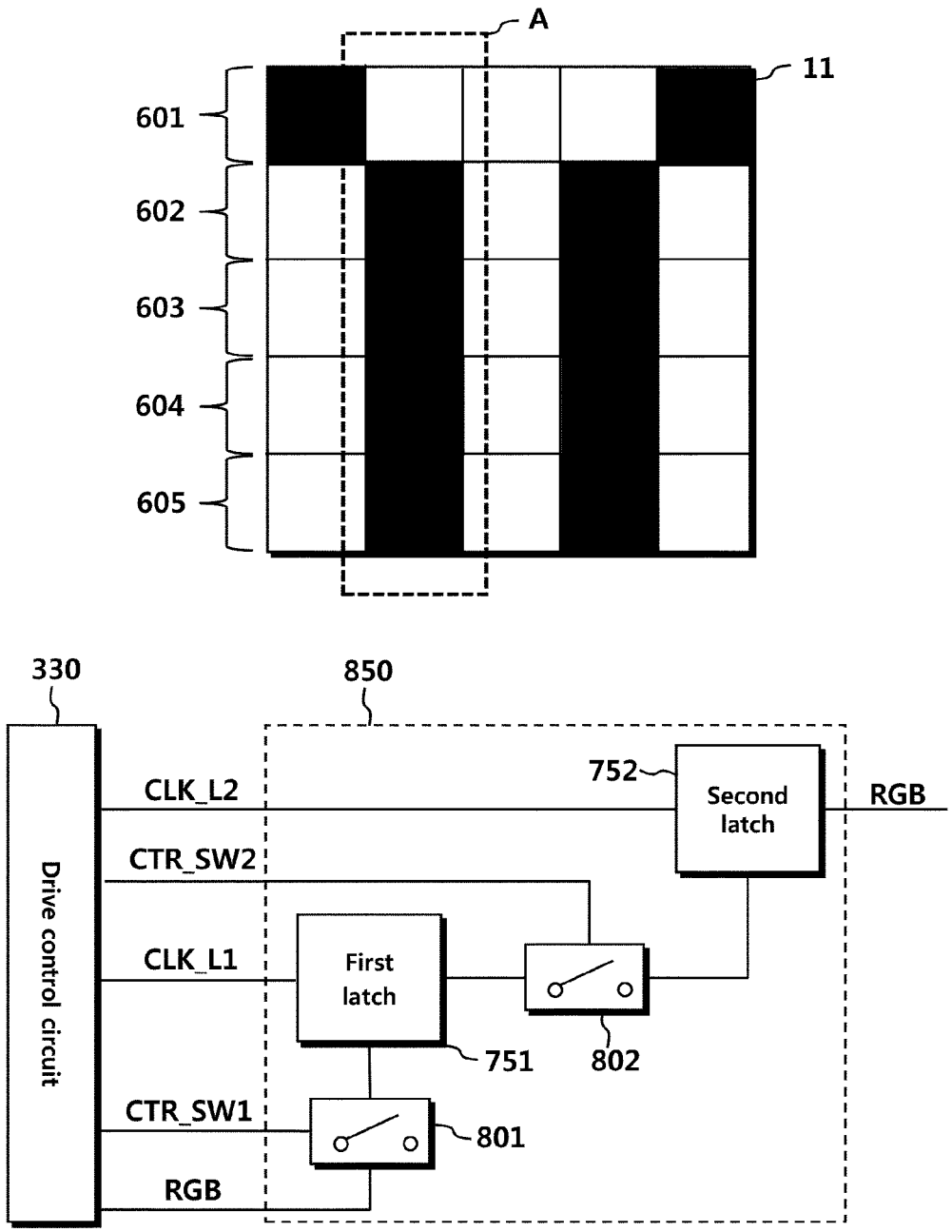
FIG. 8 is a diagram illustrating a second example of controlling a latch to supply image data of a previous line to a current line according to an embodiment.

FIG. 8 is a diagram illustrating a second example of controlling a latch to supply image data of a previous line according to an embodiment.

Referring to FIG. 8, according to a second example, the source driver may output again image data RGB for a previous line to a current line by controlling a latch circuit 850. The latch circuit 850 may comprise a first latch 751, a second latch 752, a first switch 801, and a second switch 802.

The first switch 801 may be connected with the first latch 751 so as to control the transmission of image data RGB to the first latch 751. The drive control circuit 330 may control the first switch 801 by a first switching signal CTR_SW1. The first switch 801 may open or close according to the first switching signal CTR_SW1.

The second switch 802 may be connected between the first latch 751 and the second latch 752 so as to control the transmission of image data RGB from the first latch 751 to the second latch 752. The drive control circuit 330 may control the second switch 802 by a second switching signal CTR_SW2. The second switch 802 may open or close according to the second switching signal CTR_SW2.

The drive control circuit 330 may repeatedly output image data RGB for a previous line to a current line by controlling the on-off of the first switch 801 and the second switch 802. The first latch 751 and the second latch 752 may repeatedly output a bit value of image data RGB of a pixel located in a previous line of a certain column (channel) to a pixel located in a current line of the same column (channel).

For example, in a case when greyscale values of (255, 0, 0, 0, 0) are respectively outputted to the first line 601 to the fifth line 605 of a second column in an area A marked by a dotted line, a latch circuit 850 assigned to the second column (the second channel) A may repeatedly output the greyscale value of 0, which corresponds to image data RGB for the second line 602 of the second column, to the third line through the fifth line 603, 604, 605 of the same column.

The drive control circuit 330 may control the latch circuit 850 such that the second latch 752 repeatedly outputs image data RGB for a previous line to a current line by controlling control signals supplied to the first switch 801 and the second switch 802.

For example, the second latch 752 may store image data RGB regarding the greyscale value of 0 outputted to the second line 602 of the second column A Since a greyscale value of a pixel comprises 8 bits (a first to an eighth bits), the second latch 752 may store values of the 8 bits. In this figure, the second latch 752 may store image data RGB regarding the greyscale value of 0. The second latch 752 may output image data RGB regarding the greyscale value of 0 stored according to a control signal generated by the drive control circuit 330.

Specifically, the drive control circuit 330 may receive a data packet from the timing controller and generate a control signal according to data included in a control block of the data packet. A control signal may comprise a first latch clock CLK_L1 for driving the first latch 751, a second latch clock CLK_L2 for driving the second latch 752, a first switching signal CTR_SW1 for driving the first switch 801, and a second switching signal CTR_SW2 for driving the second switch 802. The drive control circuit 330 may open the second switch 802 using the second switching signal CTR_SW2. Then, the first latch 751 may not output stored image data RGB to the second latch 752 and the second latch 752 may maintain the image data RGB for the second line 602 without being updated. In this way, the second latch 752 may repeatedly output image data RGB, regarding the greyscale value of 0 of the second line 602, to the third line to the fifth line 603, 604, 605.

In addition, the drive control circuit 330 may block image data RGB from being inputted into the first latch 751 by opening the first switch 801 using the first switching signal CTR_SW1.

According to the second example, the latch circuit 850 may re-supply image data RGB for the second line 602 to the third through the fifth lines 603, 604, 605 in each of a first to a fifth columns (channels). The latch circuits 850 for the first, third, and fifth columns (channels) may respectively repeatedly output image data RGB corresponding to a greyscale value of 255 and the latch circuits 850 for the second and the fourth columns (channels) may respectively output repeatedly image data RGB corresponding to a greyscale value of 0. The source driver may repeatedly output image data RGB for a previous line to a current line without newly receiving the same image data RGB in every column (channel).

Figure 9:
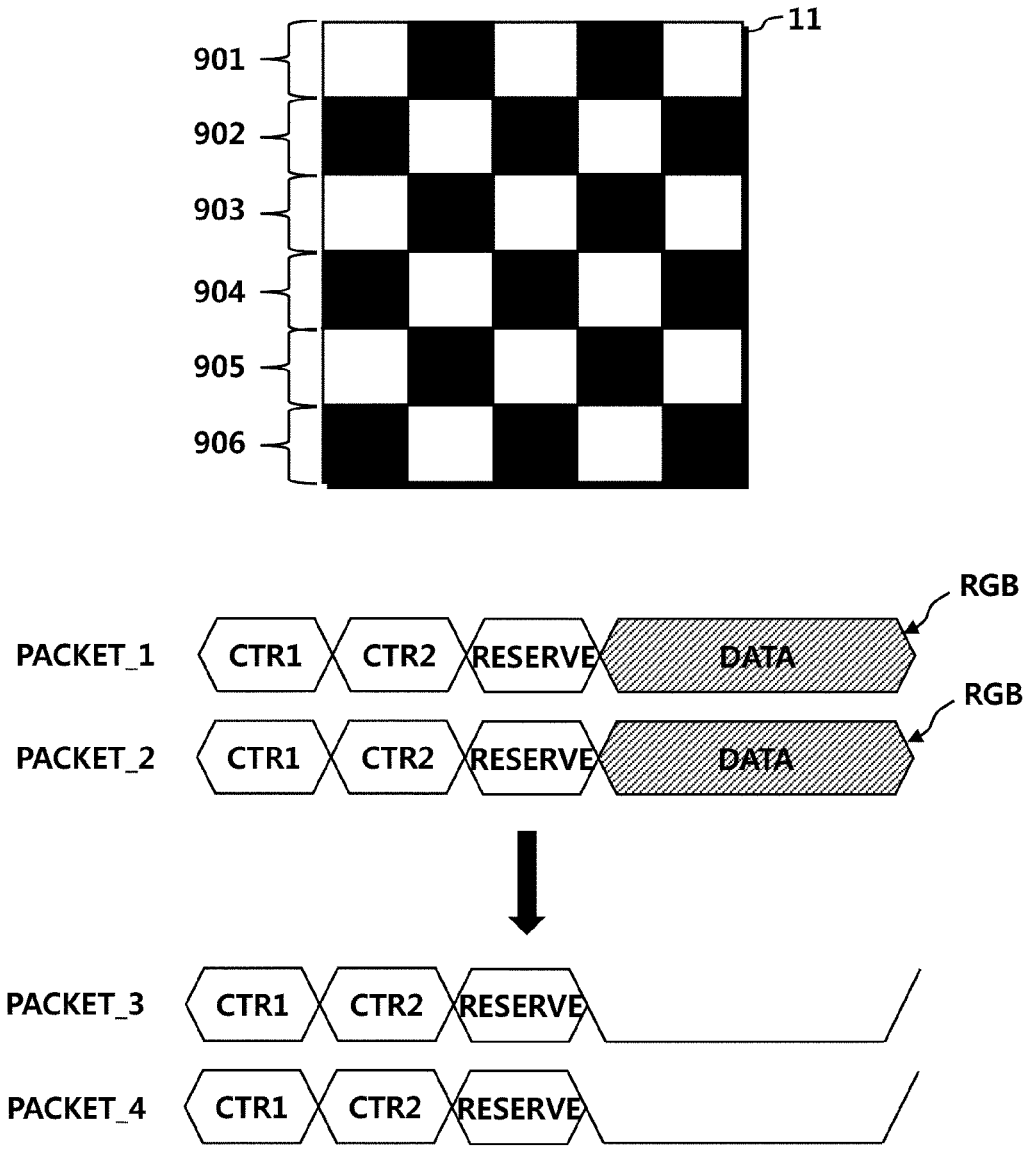
FIG. 9 is a diagram illustrating a data packet according to another embodiment.

FIG. 9 is a diagram illustrating a data packet according to another embodiment.

In a case when image data RGB varies in every line but the variation is repeated in every certain number of lines, the timing controller may control the source driver to re-output image data for a plurality of previous lines to a plurality of current lines.

FIG. 9 shows data packets generated by the timing controller in a case when image data RGB of a plurality of previous lines is identical to image data RGB for a plurality of subsequent lines. When the timing controller compares image data RGB for a plurality of previous lines with image data RGB for a plurality of subsequent lines and determines that they are identical, it may generate a plurality of data packets including commands to re-use image data RGB of a plurality of previous lines for a plurality of subsequent lines. The timing controller may not include image data RGB in the plurality of data packets.

For example, supposing that greyscale values of (255, 0, 255, 0, 255) and (0, 255, 0, 255, 0) are alternately outputted respectively to pixels in a first to a sixth lines 901, 902, 903, 904, 905, 906 of the panel 11, the greyscale values of image data for a third line and a fourth line 903, 904 and the greyscale values of image data for a first line and a second line 901, 902 may identically be (255, 0, 255, 0, 255/0, 255, 0, 255, 0). The greyscale values of image data for a fifth and a sixth lines and the greyscale values of image data for the first line and the second line 901, 902 may identically be (255, 0, 255, 0, 255/0, 255, 0, 255, 0). The timing controller may generate a first data packet PACKET_1 including image data RGB for the first line 901 in a data block DATA to transmit it to the source driver and generate a second data packet PACKET_2 including image data RGB for the second line 902 in a data block DATA to transmit it to the source driver.

The timing controller may compare image data RGB for the third line and the fourth line 903, 904 with image data RGB for the first line and the second line 901, 902 before transmitting the image data RGB for the third line and the fourth line 903, 904 to the source driver. Since the greyscale values for the third line and the fourth line 903, 904 belonging to a second group and those for the first line and the second line 901, 902 belonging to a first group are identically respectively (255, 0, 255, 0, 255/0, 255, 0, 255, 0), the comparator of the timing controller may determine that the two pieces of image data RGB for the lines respectively belonging to the two groups are identical.

The timing controlling circuit of the timing controller may generate a third data packet PACKET_3 according to the aforementioned determination. The timing controlling circuit may not include, in a data block DATA, the image data RGB for the third line 903, which is identical to the image data RGB for the first line 901. The data block DATA may have logical levels of 0 only or 1 only. Or, the data block DATA may include any other data in an arbitrary format.

The timing controlling circuit may include, in control blocks CTR1, CTR2, command data to re-output image data RGB for the first line 901 to the third line 903. That is, the command data may comprise information that, since the image data RGB for the third line 903 is identical to the image data RGB for the first line 901, the image data RGB for the first line 901 is re-supplied to the third line 903. The timing controlling circuit may or may not include a clock in a data block.

The timing controlling circuit of the timing controller may generate a fourth data packet PACKET_4 according to the aforementioned determination. The timing controlling circuit may not include, in a data block DATA, image data RGB for the fourth line 904, which is identical to image data RGB for the second line 902. The data block DATA may have logical levels of 0 only or 1 only. Or, the data block DATA may include any other data in an arbitrary format.

The timing controlling circuit may include, in control blocks CTR1, CTR2, command data to re-output image data RGB for the second line 902 to the fourth line 904. That is, the command data may comprise information that, since the image data RGB for the fourth line 904 is identical to the image data RGB for the second line 902, the image data RGB for the second line 902 is re-supplied to the fourth line 904. The timing controlling circuit may or may not include a clock in a data block.

If the comparator determines the image data RGB for the first line and the second line 901, 902 is different from the image data RGB for the third line and the fourth line 903, 904, the timing controlling circuit may include, in the data block DATA of the third data packet PACKET_3, data different from image data RGB for the first line 201. In addition, the timing controlling circuit may not include, in the control blocks CTR1, CTR2 of the third data packet PACKET_3, command data to re-output the image data RGB for the first line 901 to the third line 903 of the panel 11. That is, the data included in the control blocks CTR1, CTR2 of the third data packet PACKET_3 may comprise information that, since the image data RGB for the third line 903 is different from the image data RGB for the first line 901, the image data RGB included in the third data packet PACKET_3 is supplied to the third line 903.

In addition, if the comparator determines the image data RGB for the first line and the second line 901, 902 is different from the image data RGB for the third line and the fourth line 903, 904, the timing controlling circuit may include, in the data block DATA of a fourth data packet PACKET_4, data different from the image data RGB for the second line 902. In addition, the timing controlling circuit may not include, in the control blocks CTR1, CTR2 of the fourth data packet PACKET_4, command data to re-output the image data RGB for the second line 902 to the fourth line 904 of the panel 11. That is, the data included in the control blocks CTR1, CTR2 of the fourth data packet PACKET_4 may comprise information that, since the image data RGB for the fourth line 904 is different from the image data RGB for the second line 902, the image data RGB included in the fourth data packet PACKET_4 is supplied to the fourth line 904.

Figure 10:
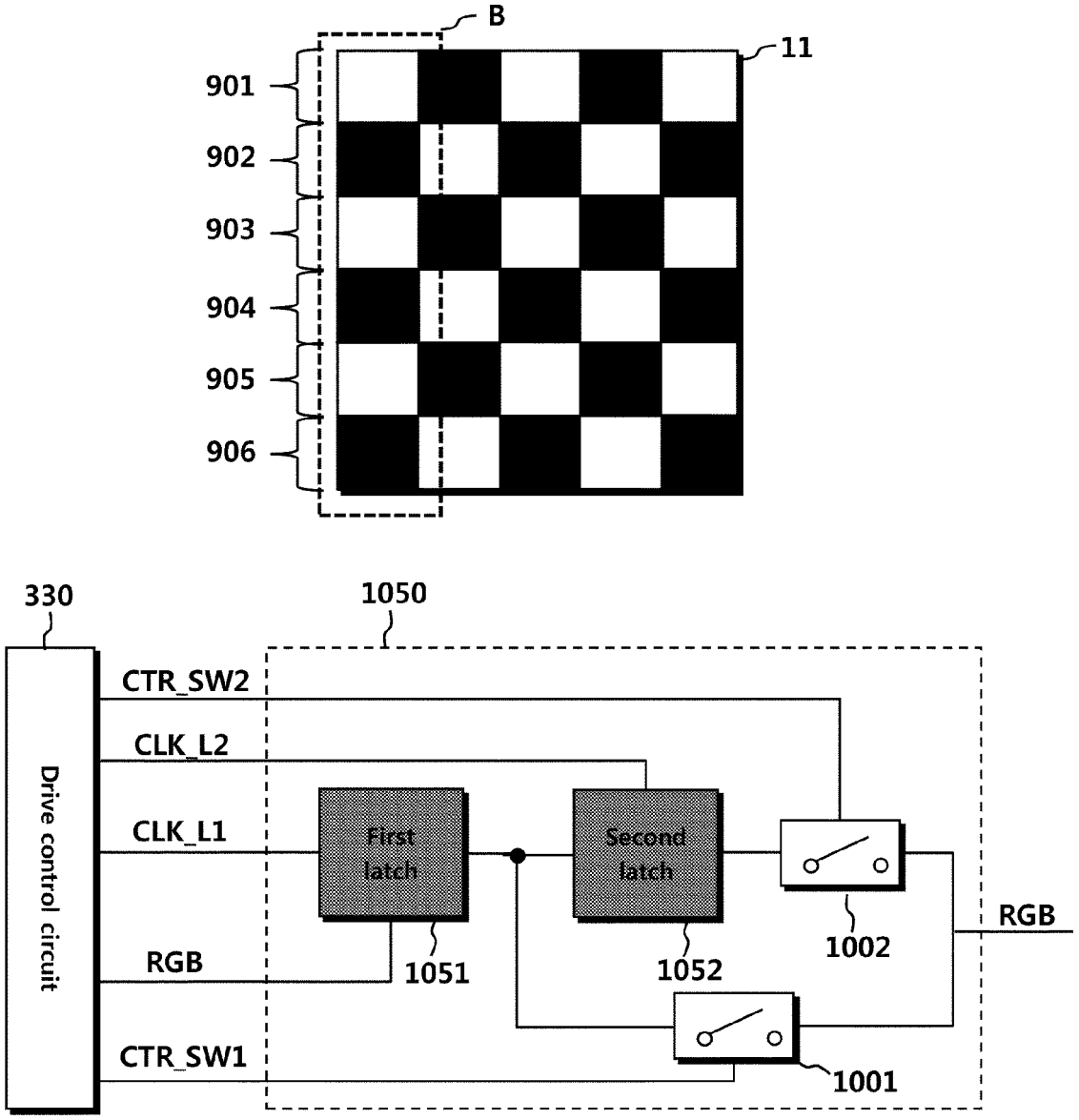
FIG. 10 is a diagram illustrating a first example of controlling a latch to supply image data of a previous line to a current line according to another embodiment.

FIG. 10 is a diagram illustrating a first example of controlling a latch to supply image data of a previous line according to another embodiment.

Referring to FIG. 10, the source driver may re-output image data RGB for a plurality of previous lines to a plurality of subsequent lines by controlling a latch circuit 1050 according to a first example. The latch circuit 1050 may comprise a first latch 1051, a second latch 1052, a first switch 1001, and a second switch 1002.

The first switch 1001 may be connected with the second switch 1002 so that image data RGB stored in the first latch 1051 is outputted to the DAC. The drive control circuit 330 may control the first switch 1001 using a first switching signal CTR_SW1. The first switch 1001 may open or close according to the first switching signal CTR_SW1.

The second switch 1002 may be connected between the first switch 1001 and the second latch 1052 so as to control the output of image data RGB from the second latch 1052. The drive control circuit 330 may control the second switch 1002 using a second switching signal CTR_SW2. The second switch 1002 may open or close according to the second switching signal CTR_SW2.

The drive control circuit 330 may repeatedly output image data RGB for a plurality of previous lines to a plurality of current lines by controlling the states of the first latch 1051 and the second latch 1052 and the on-offs of the first switch 1001 and the second switch 1002. The first latch 1051 and the second latch 1052 may repeatedly output bit values (0 or 1), of image data RGB for a plurality of pixels located in a plurality of previous lines of a certain column (channel), to a plurality of pixels located in a plurality of subsequent lines of the same column (channel).

For example, greyscale values of (255, 0, 255, 0, 255, 0) may be outputted respectively to a first line 901 to a sixth line 906 of a first column, a third column, and a fifth column, and greyscale values of (0, 255, 0, 255, 0, 255) may be outputted respectively to a first line 901 to a sixth line 906 of a second column and a fourth column. The latch circuit 1050 assigned to the first column (the first channel, a dotted line area) B may repeatedly output image data RGB, corresponding to the greyscale values for the first line and the second line 901, 902 of the first column, to the third to the sixth lines 903, 904, 905, 906 of the same column.

The drive control circuit 330 may control the latch circuit 1050 such that the first latch 1051 and the second latch 1052 repeatedly output image data RGB, regarding greyscale values for a plurality of previous lines, to a plurality of subsequent lines by controlling control signals supplied to the first latch 1051, the second latch 1052, the first switch 1001, and the second switch 1002.

Specifically, the drive control circuit 330 may receive a plurality of data packets corresponding to the first to the sixth lines 901, 902, 903, 904, 905, 906 from the timing controller and generate control signals according to data included in control blocks of the plurality of data packets. A control signal may comprise a first latch clock CLK_L1 for driving the first latch 1051, a second latch clock CLK_L2 for driving the second latch 1052, a first switching signal CTR_SW1 for driving the first switch 1001, and a second switching signal CTR_SW2 for driving the second switch 1002. The drive control circuit 330 may control the first and the second latches 1051, 1052 to store image data RGB by the first and the second latch clocks CLK_L1, CLK_L2. The drive control circuit 330 may alternately perform the opening and closing of the first switch 1001 using the first switching signal CTR_SW1 and the opening and closing of the second switch 1002 using the second switching signal CTR_SW2. The first latch 1051 may output stored image data RGB when the first switch 1001 closes and the second switch 1002 opens, whereas the second latch 1052 may output stored image data RGB when the second switch 1002 closes and the first switch 1001 opens.

For example, the second latch 1052 may store image data RGB regarding the greyscale value of 255 of the first line 901 in the first column B by the second latch clock CLK_L2 (the second latch 1052 in a storing state is represented by shade). The first latch 1051 may store image data RGB regarding the greyscale value of 0 of the second line 902 in the first column B by the first latch clock CLK_L1 (the first latch 1051 in a storing state is represented by shade). Since the second latch 1052 does not newly receive any data, image data RGB of the first latch 1051 may not be transferred to the second latch 1052. Then, when the second switch 1002 closes and the first switch 1001 opens, the second latch 1052 may output image data RGB regarding the greyscale value of 255 to the first line 901 of the first column B. When the first switch 1001 closes and the second switch 1002 opens, the first latch 1051 may output image data RGB regarding the greyscale value of 0 to the second line 902 of the first column B. Then, when the second switch 1002 closes and the first switch 1001 opens again, the second latch 1052 may output image data RGB regarding the greyscale value of 255 to the third line 903 of the first column B. When the first switch 1001 closes and the second switch 1002 opens, the first latch 1051 may output image data RGB regarding the greyscale value of 0 to the fourth line 904 of the first column B The latch circuit 1050 may perform the same operation for the fifth and the sixth lines 905, 906 of the first column B.

According to a first example, the latch circuit 1050 may re-supply image data RGB of the first line and the second line 901, 902 to the third through the sixth lines 903, 904, 905, 906 in each of a first through a fifth columns (channels). The latch circuits 1050 for the first, third, and fifth columns (channels) may repeatedly output image data RGB respectively corresponding to the greyscale values of (255, 0) and the latch circuits 1050 for the second and the fourth columns (channels) may repeatedly output image data RGB respectively corresponding to the greyscale values of (0, 255). The source driver may repeatedly output image data RGB for a plurality of previous lines to a plurality of subsequent lines without newly receiving the same image data RGB in every column (channel).

Figure 11:
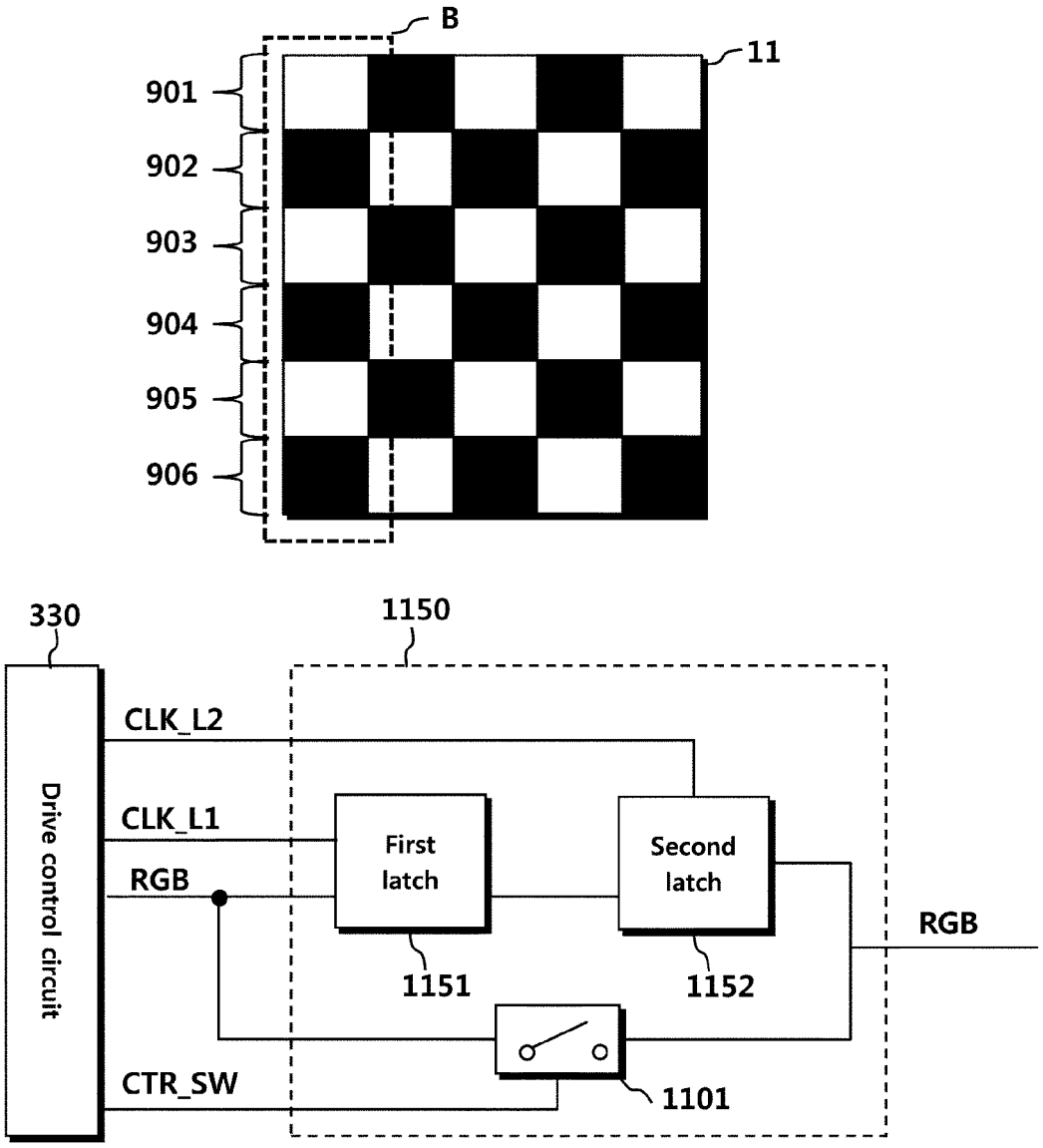
FIG. 11 is a diagram illustrating a second example of controlling a latch to supply image data of a previous line to a current line according to another embodiment.

FIG. 11 is a diagram illustrating a second example of controlling a latch to supply image data of a previous line according to another embodiment.

Referring to FIG. 11, the source driver may re-output image data RGB for a plurality of previous lines to a plurality of subsequent lines by controlling a latch circuit 1150 according to a second example. The latch circuit 1150 may comprise a first latch 1151, a second latch 1152, and a switch 1101.

The switch 1101 may be connected with the first latch 1151 and the second latch 1152 so that the output from the second latch 1152 may be inputted to the first latch 1151. The switch 1101 may be connected between the first latch 1151 and the second latch 1152 so that the first latch 1151 and the second latch 1152 may circulate image data RGB and output it to the DAC. The drive control circuit 330 may control the switch 1101 by a switching signal CTR_SW. The switch 1101 may open or close according to the first switching signal CTR_SW.

The drive control circuit 330 may repeatedly output image data RGB for a plurality of previous lines to a plurality of current lines by controlling the states of the first latch 1151 and the second latch 1152 and the on-off of the switch 1101. The first latch 1151 and the second latch 1152 may repeatedly output bit values (0 or 1), of image data RGB for a plurality of pixels located in a plurality of previous lines of a certain column (channel), to a plurality of pixels located in a plurality of subsequent lines of the same column (channel).

For example, in a case when greyscale values are outputted to the panel 11 as shown in FIG. 10, the latch circuit 1150, assigned to the first column (the first channel, the dotted line area) B, may repeatedly output image data RGB corresponding to the greyscale values of the first line and the second line 901, 902 in the first column to third to the sixth lines 903, 904, 905, 906 of the same column.

The drive control circuit 330 may control the latch circuit 1150 such that the first latch 1151 and the second latch 1152 repeatedly output image data RGB, regarding greyscale values for a plurality of previous lines, to a plurality of subsequent lines by controlling control signals supplied to the first latch 1151, the second latch 1152, and the switch 1101.

Specifically, the drive control circuit 330 may receive a plurality of data packets corresponding to the first to the sixth lines 901, 902, 903, 904, 905, 906 from the timing controller and generate control signals according to data included in control blocks of the plurality of data packets. A control signal may comprise a first latch clock CLK_L1 for driving the first latch 1151, a second latch clock CLK_L2 for driving the second latch 1152, and a switching signal CTR_SW for driving the switch 1101. The drive control circuit 330 may control, using the first and the second latch clocks CLK_L1, CLK_L2, the first and the second latches 1151, 1152 to circulate image data RGB between them and output it to the DAC.

The drive control circuit 330 may control the first latch 1151 to operate in an enabled state by supplying the first latch clock CLK_L1 to the first latch 1151. In an enabled state, the first latch 1151 may operate differently from the storing state. In the enabled state, the first latch 1151 may not store image data RGB and newly receive image data RGB and output it. The drive control circuit 330 may enable the second latch 1152 by supplying the second latch clock CLK_L2 to the second latch 1152. Then, the second latch 1152 as well may not store image data RGB and newly receive image data RGB and output it. When the drive control circuit 330 closes the switch 1101 by the switching signal CTR_SW, the second latch 1152 may output second image data, which has been stored therein, simultaneously to the first latch 1151 and to the DAC through a feedback path to which the switch 1101 is connected. The first latch 1151 may output first image data, which has been stored therein, to the second latch 1152, receive second image data from the second latch 1152, and output the inputted second image data to the second latch 1152. The second latch 1152 may receive the first image data from the first latch 1151 and output the inputted first image data simultaneously to the first latch 1151 and to the DAC through the feedback path. When the drive control circuit 330 opens the switch 1101 by the switching signal CTR_SW, the drive control circuit 330 may stop the circulation of image data RGB between the first and the second latches 1151, 1152.

For example, the second latch 1152 may receive image data RGB, regarding the greyscale value of 255 of the first line 901 in the first column B, from the first latch 1151 in the enabled state by the second latch clock CLK_L2. The first latch 1151 may receive image data RGB regarding the greyscale value of 0 of the second line 902 in the first column B in the enabled state by the first latch clock CLK_L1.

When the switch 1101 closes, the second latch 1152 may output the image data RGB regarding the greyscale value of 255 of the first line 901 in the first column B and the first latch 1151 may output the image data RGB regarding the greyscale value of 0 to the second latch 1152 at the same time of receiving the image data RGB regarding the greyscale value of 255 from the second latch 1152. The second latch 1152 may receive the image data RGB regarding the greyscale value of 0 from the first latch 1151.

In addition, the second latch 1152 may output the image data RGB regarding the greyscale value of 0 of the second line 902 in the first column B and the first latch 1151 may output the image data RGB regarding the greyscale value of 255 to the second latch 1152 at the same time of receiving the image data RGB regarding the greyscale value of 0 from the second latch 1152. The second latch 1152 may receive the image data RGB regarding the greyscale value of 255 from the first latch 1151.

The second latch 1152 may output the image data RGB regarding the greyscale value of 255 of the third line 903 in the first column B and the first latch 1151 may output the image data RGB regarding the greyscale value of 0 to the second latch 1152 at the same time of receiving the image data RGB regarding the greyscale value of 255 from the second latch 1152. The second latch 1152 may receive the image data RGB regarding the greyscale value of 0 from the first latch 1151.

The second latch 1152 may output the image data RGB regarding the greyscale value of 0 of the fourth line 904 in the first column B and the first latch 1151 may output the image data RGB regarding the greyscale value of 255 to the second latch 1152 at the same time of receiving the image data RGB regarding the greyscale value of 0 from the second latch 1152. The second latch 1152 may receive the image data RGB regarding the greyscale value of 255 from the first latch 1151.

The latch circuit 1150 may perform the same operation for the fifth and the sixth lines 905, 906 of the first column B.

When the switch 1101 opens, image data RGB does not circulate between the first and the second latches 1151, 1152, the first and the second latches 1151, 1152 may be in the storing state, in which the first and the second latches 1151, 1152 store image data RGB, by the first and the second latch clocks CLK_L1, CLK_L2.

According to a second example, the latch circuit 1150 may re-supply image data RGB of the first line and the second line 901, 902 to the third to the sixth lines 903, 904, 905, 906 in each of a first to a fifth columns (channels). The latch circuits 1150 for the first, third, and fifth columns (channels) may repeatedly output image data RGB respectively corresponding to the greyscale values of (255, 0) and the latch circuits 1150 for the second and the fourth columns (channels) may repeatedly output image data RGB respectively corresponding to the greyscale values of (0, 255). The source driver may repeatedly output image data RGB for a plurality of previous lines to a plurality of subsequent lines without newly receiving the same image data RGB in every column (channel).

Figure 12:
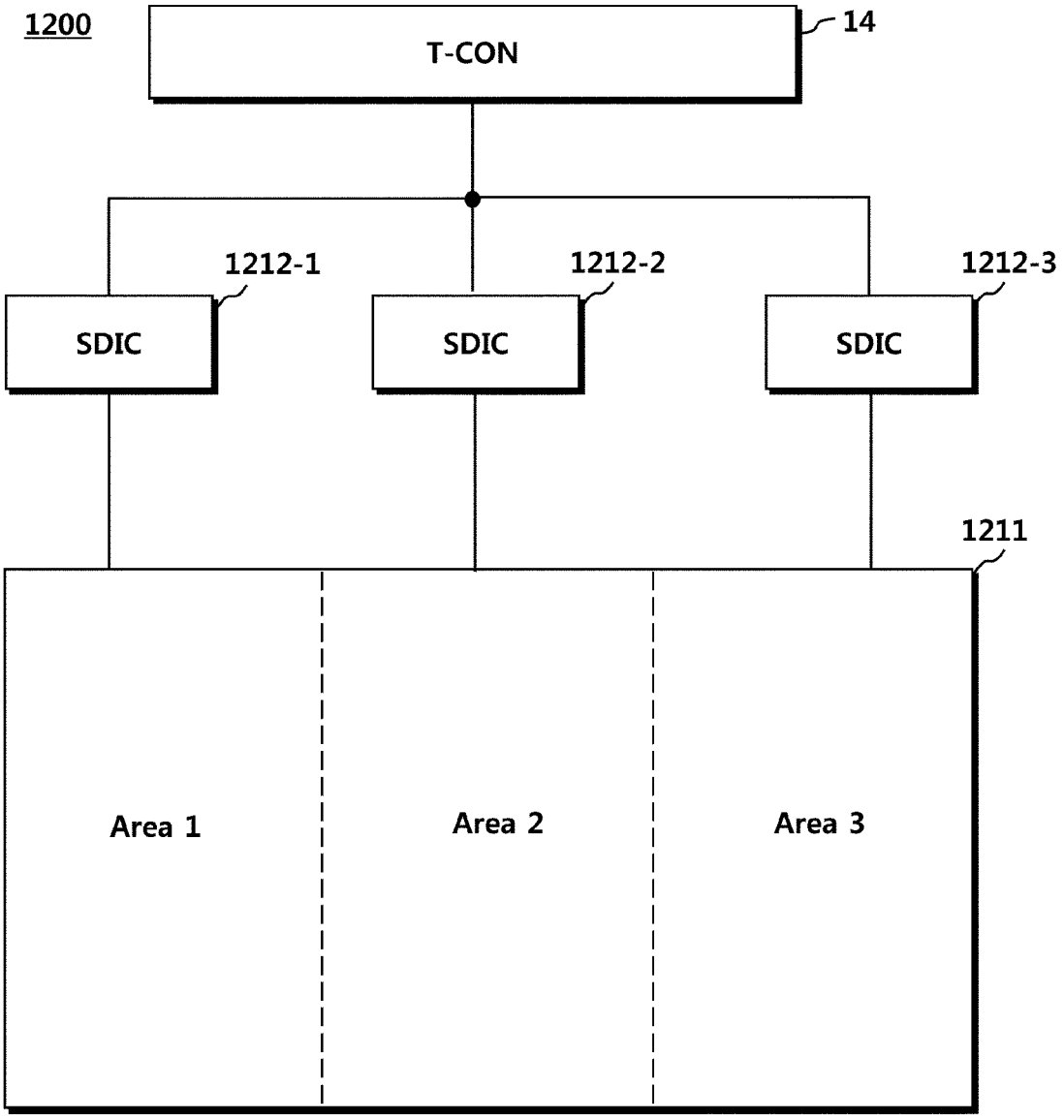
FIG. 12 is a diagram illustrating a plurality of source drivers to separately drive a plurality of areas of a panel and a timing controller to drive the plurality of source drivers according to another embodiment.

FIG. 12 is a diagram illustrating a plurality of source drivers to separately drive a plurality of areas of a panel and a timing controller to drive the plurality of source drivers according to another embodiment.

Referring to FIG. 12, a display device 1200 may comprise a timing controller 14, a plurality of source drivers 1212-1, 1212-2, 1212-3, and a panel 1211 comprising a plurality of areas.

The panel 1211 may be divided into a plurality of areas including area 1, area 2, and area 3. The panel 1211 is not required to be divided in terms of hardware, but may be divided in terms of software. Each area may comprise a plurality of pixels disposed in a form of a matrix so as to have a plurality of lines (rows) and channels (columns) comprising pixels.

Each of the plurality of source drivers 1212-1, 1212-2, 1212-3 may independently drive each area of the panel 1211. A first source driver 1212-1 may independently drive pixels belonging to area 1. The first source driver 1212-1 may supply data voltages corresponding to image data to the pixels by channel in area 1. A second source driver 1212-2 may independently drive pixels belonging to area 2. The second source driver 1212-2 may supply data voltages corresponding to image data to the pixels by channel in area 2. A third source driver 1212-3 may independently drive pixels belonging to area 3. The third source driver 1212-3 may supply data voltages corresponding to image data to the pixels by channel in area 3.

In a case when image data for a previous line is identical to image data for a current line, each of the plurality of source drivers 1212-1, 1212-2, 1212-3 may supply a data voltage corresponding to image data for a previous line to a current line in the corresponding area. For example, in a case when image data for a first line is identical to image data for a second line in area 1, the first source driver 1212-1 may re-supply a data voltage corresponding to the image data for the first line to the second line. The second source driver 1212-2 and the third source driver 1212-3 may perform the same operation respectively in area 2 and area 3. The plurality of source drivers 1212-1, 1212-2, 1212-3 may separately perform this operation.

In a case when image data for a plurality of previous lines is identical to image data for a plurality of subsequent lines, each of the plurality of source drivers 1212-1, 1212-2, 1212-3 may also re-supply data voltages corresponding to image data for the plurality of previous lines to the plurality of subsequent lines in the respective areas. For example, in a case when image data for a first line and a second line is identical to image data for a third line and a fourth line in area 1, the first source driver 1212-1 may re-supply data voltages corresponding to image data for the first line and the second line to the third line and the fourth line. The second source driver 1212-2 and the third source driver 1212-3 may perform the same operation respectively in area 2 and area 3. The plurality of source drivers 1212-1, 1212-2, 1212-3 may separately perform this operation.

The timing controller 14 may separately control each of the plurality of source drivers 1212-1, 1212-2, 1212-3. The timing controller 14 may control the first source driver 1212-1 by transmitting a first data packet, control the second source driver 1212-2 by transmitting a second data packet, and control the third source driver 1212-3 by transmitting a third data packet. The timing controller 14 may separately transmit each of the first to the third data packets.

When the timing controller 14 determines image data for a previous line is identical to image data for a current line, the timing controller 14 may generate a data packet including command data to repeatedly output image data for a previous line to a current line and transmit it to the plurality of source drivers 1212-1, 1212-2, 1212-3. Each of the plurality of source drivers 1212-1, 1212-2, 1212-3 may re-supply a data voltage corresponding to image data for a previous line to a current line in each of area 1 to area 3 according to the data packet.

When the timing controller 14 determines image data for a plurality of previous lines is identical to image data for a plurality of current lines, the timing controller 14 may generate a data packet including command data to repeatedly output image data for a plurality of previous lines to a plurality of current lines and transmit it to the plurality of source drivers 1212-1, 1212-2, 1212-3. Each of the plurality of source drivers 1212-1, 1212-2, 1212-3 may re-supply data voltages corresponding to image data for a plurality of previous lines to a plurality of current lines in each of area 1 to area 3 according to the data packet.

Although an embodiment of the present disclosure describes a display device 1200 comprising three source drivers respectively driving three areas of a panel, the present disclosure is not limited to this, but the numbers of source drivers and areas of a panel may increase or vary.

Figure 13:
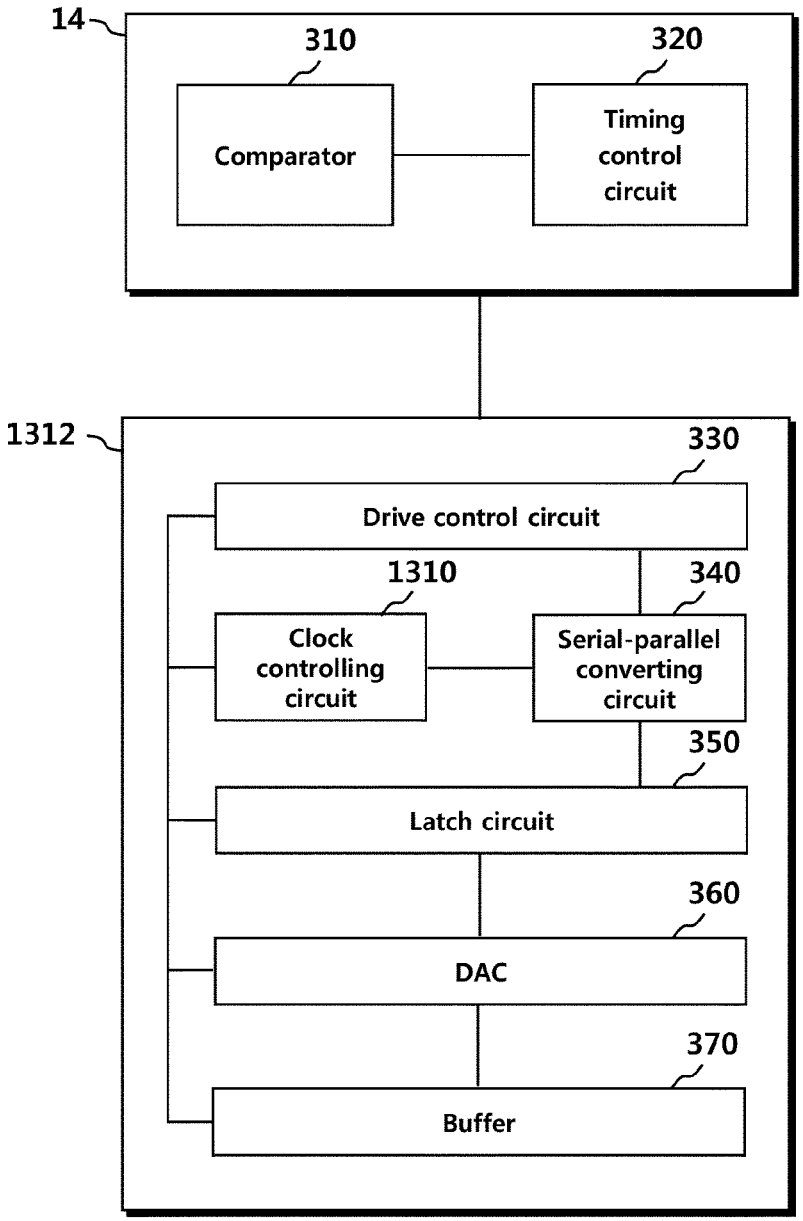
FIG. 13 is a configuration diagram of a timing controller and a source driver according to still another embodiment.

FIG. 13 is a configuration diagram of a timing controller and a source driver according to still another embodiment.

Referring to FIG. 13, a source driver 1312 may further comprise a clock control circuit 1310.

The clock control circuit 1310 may mask a clock to deactivate a component receiving the clock. For example, the clock control circuit 1310 may deactivate a serial-parallel converting circuit 340 by masking (deactivating) a clock inputted from a drive control circuit 330 into the serial-parallel converting circuit 340.

In a case when image data for a previous line is identical to image data for a current line and the source driver 1312 does not newly receive image data, a latch circuit 350 may repeatedly supply image data, and thus, the serial-parallel converting circuit 340 may not necessarily be activated. The drive control circuit 330 may control the clock control circuit 1310 to deactivate the serial-parallel converting circuit 340 using a control signal so as to reduce power consumption due to the serial-parallel converting circuit 340. An embodiment of the present disclosure allows reducing total power consumption of a display device by reducing power consumption due to unnecessary functions.

The clock control circuit 1310 may stop masking operation for a clock to activate a component receiving the clock.

What is claimed is:

1. A source driver comprising:

a drive control circuit to receive a data packet, including a control block and a data block, and to generate a control signal according to the control block; and a latch circuit, comprising a first latch and a second latch, to output image data stored in the first latch or the second latch according to the control signal, a serial-parallel converting circuit to convert image data received in series into image data in parallel and to output it to the latch circuit; and a clock control circuit to deactivate the serial-parallel converting circuit according to the control signal, wherein, in a case when first image data outputted to a first line is identical to second image data outputted to a second line, data included in the control block commands the second line to reuse the first image data and the data block does not include the second image data.

2. The source driver of claim 1, wherein the data block embeds a clock therein.

3. The source driver of claim 1, wherein the data block comprises a part, into which image data is inserted, having logical levels of 0 only or 1 only or any data.

4. The source driver of claim 1, wherein the latch circuit comprises a switch connecting the first latch and the second latch and opens the switch according to the control signal, and the second latch stores the first image data in a first time section where the first line is driven and outputs the first image data to the second line in a second time section where the second line is driven.

5. A source driver comprising:

a drive control circuit to receive a plurality of data packets, each including a control block and a data block, and to generate control signals according to the control blocks; and a latch circuit, comprising a first latch and a second latch, to output image data stored in the first latch or the second latch according to the control signals, a serial-parallel converting circuit to convert image data received in series into image data in parallel and to output it to the latch circuit; and a clock control circuit to deactivate the serial-parallel converting circuit according to the control signal, wherein, in a case when image data of a first group comprising a first line and a second line is identical to image data of a second group comprising a third line and a fourth line, data included in the control block commands the second group to reuse the image data for the first group and the data block does not include the image data for the second group.

6. The source driver of claim 5, wherein the plurality of data packets include a first data packet comprising a first control block to command the third line to reuse image data for the first line and a first data block, and a second data packet comprising a second control block to command the fourth line to reuse image data for the second line and a second data block, the drive control circuit generates a first control signal according to the first control block and a second control signal according to the second control block, and the latch circuit outputs the image data for the first line to the third line according to the first control signal and the image data for the second line to the fourth line according to the second control signal.

7. The source driver of claim 5, wherein the latch circuit comprises a first switch connected with the first latch and a second switch connected with the second latch and outputs the image data for the first group to the second group by alternately closing the first switch and the second switch.

8. The source driver of claim 7, wherein the first switch closes, the second switch is connected between the first latch and the second latch so that an output from the second latch is inputted into the first latch, and the latch circuit supplies image data for the first group to the second group according to an opening or a closing of the second switch.

9. The source driver of claim 6, wherein the first and the second data blocks respectively embed clocks therein.

10. The source driver of claim 6, wherein the first and the second data blocks respectively comprise parts, into which image data is inserted, each having logical levels of 0 only or 1 only or any data.

11. A display device comprising:

a panel comprising a plurality of pixels disposed to form lines, the panel being divided into a plurality of areas, each including a first line and a second line;

a plurality of source drivers to respectively drive the plurality of areas of the panel; and a timing controller to generate a data packet comprising a control block and a data block for each area and to transmit the data packet to a corresponding source driver, wherein, in a case when first image data outputted to the first line is identical to second image data outputted to the second line in each area, data included in the control block commands the second line to reuse the first image data and the data block does not include the second image data, wherein each of the plurality of source drivers circuits comprises:

a latch circuit, comprising a first latch and a second latch, to output the first image data to the second line according to a control signal generated on a basis of the control block by the first and the second latches, a serial-parallel converting circuit to convert image data received in series into image data in parallel and to output it to the latch circuit, and a clock control circuit to deactivate the serial-parallel converting circuit according to the control signal.

12. The display device of claim 11, wherein the timing controller embeds a clock in the data block.

13. The display device of claim 11, wherein the data block comprises a part, into which image data is inserted, having logical levels of 0 only or 1 only or any data.

14. The display device of claim 11, wherein, in a case when image data of a first group including a first line and a second line is identical to image data of a second group including a third line and a fourth line in each area, the timing controller generates a plurality of data packets for respective areas, each comprising a control block including data to command the second group to reuse image data for the first group and a data block not including image data, and transmits the plurality of data packets respectively to the corresponding source drivers.

* * * * *